US007757893B2

(12) United States Patent
Perell

(10) Patent No.: US 7,757,893 B2
(45) Date of Patent: Jul. 20, 2010

(54) DISPERSING BUBBLE WITH COMPRESSIBLE TRANSPORT FLUID AND METHOD

(75) Inventor: William S. Perell, San Francisco, CA (US)

(73) Assignee: Poppack LLC, San Francisco, CA (US)

( * ) Notice: Subject to any disclaimer, the term of this patent is extended or adjusted under 35 U.S.C. 154(b) by 641 days.

(21) Appl. No.: 11/581,530

(22) Filed: Oct. 17, 2006

(65) Prior Publication Data

US 2007/0295766 A1 Dec. 27, 2007

Related U.S. Application Data

(60) Provisional application No. 60/816,045, filed on Jun. 26, 2006.

(51) Int. Cl.
*B65D 35/08* (2006.01)
*B65D 35/10* (2006.01)

(52) U.S. Cl. ..... 222/107; 222/153.06; 222/541.3; 222/541.4; 222/541.9

(58) Field of Classification Search ..... 222/92, 222/107, 153.06, 541.1, 541.6, 541.9, 491, 222/494, 541.3, 541.4
See application file for complete search history.

(56) References Cited

U.S. PATENT DOCUMENTS

| | | | | |
|---|---|---|---|---|
| 2,893,710 | A * | 7/1959 | Goodman | 222/459 |
| 3,074,544 | A | 1/1963 | Bollmeier et al. | |
| 3,189,227 | A | 6/1965 | Hobbs et al. | |
| 3,256,981 | A | 6/1966 | Kurtz | |
| 3,294,227 | A | 12/1966 | Schneider et al. | |
| 3,301,390 | A | 1/1967 | Via, Jr. | |

(Continued)

FOREIGN PATENT DOCUMENTS

| | | |
|---|---|---|
| DE | 20314741 | 1/2004 |

(Continued)

OTHER PUBLICATIONS

International Search Report for Application No. PCT/EP2007/056082, Completed Aug. 24, 2007, Mailed Sep. 13, 2007.

*Primary Examiner*—Kenneth Bomberg
(74) *Attorney, Agent, or Firm*—Dority & Manning, PA

(57) ABSTRACT

Bubble device 10 permits a user to directionally disperse a product under compressive pressure toward zone of concern 10Z. Opposed webs 10S and 10C are pressed together to form sealed perimeter 10P around a central enclosure, forming dispersing bubble 12. The perimeter has a breaching seal 10B for product dispersion and a non-breaching seal 10N along the remaining perimeter. Product 10P for dispersion and compressible product transport fluid 12F are contained within the dispersing bubble. The transport fluid is compressed and the force of compression causes the bubble to bulge toward the frangible breaching seal (see FIG. 1C). The web separation occurs inside the dispersing bubble, forcing an edge breach 12E in the breaching seal. The compressed transport fluid rapidly escapes as a released blast through the edge breach. The stored energy of compression within the bubble is released as kinetic energy of the escaping transport fluid. Opposed peel tabs 12S and 12C are formed by the enclosure material of the opposed webs proximate the edge breach as the bubble breaches. The opposed webs 10S and 10C may be completely separated forming application pads (see FIG. 1E) for applying any product residue 12R remaining on the webs after the dispersion.

19 Claims, 4 Drawing Sheets

U.S. PATENT DOCUMENTS 3,342,326 A * 9/1967 Zackheim ..... 222/211
3,573,069 A 3/1971 Keller et al.
3,608,709 A 9/1971 Pike
3,635,376 A 1/1972 Hellstrom
3,921,805 A 11/1975 Compere
4,275,840 A 6/1981 Staar
4,301,923 A 11/1981 Vuorento
4,402,402 A 9/1983 Pike
4,511,052 A 4/1985 Klein et al.
D279,808 S 7/1985 Pharo
4,540,089 A 9/1985 Maloney
4,597,244 A 7/1986 Pharo
4,610,684 A 9/1986 Knox et al.
4,632,244 A 12/1986 Landau
4,704,314 A 11/1987 Hsu et al.
4,711,359 A 12/1987 White et al.
4,759,472 A 7/1988 Strenger
4,793,123 A 12/1988 Pharo
4,798,288 A 1/1989 Holzner
4,872,556 A 10/1989 Farmer
4,872,558 A 10/1989 Pharo
4,874,093 A 10/1989 Pharo
4,890,744 A 1/1990 Lane
4,918,904 A 4/1990 Pharo
4,949,530 A 8/1990 Pharo
4,961,495 A 10/1990 Yoshida et al.
5,050,736 A 9/1991 Griesbach
5,100,028 A 3/1992 Seifert
5,114,004 A 5/1992 Isono et al.
5,126,070 A 6/1992 Leifheit et al.
5,207,320 A 5/1993 Allen
5,215,221 A 6/1993 Dirksing
5,272,856 A 12/1993 Pharo
5,325,968 A 7/1994 Sowden
5,373,966 A 12/1994 O'Reilly et al.
5,427,830 A 6/1995 Pharo
5,445,274 A 8/1995 Pharo
5,447,235 A 9/1995 Pharo
5,487,470 A 1/1996 Pharo
5,492,219 A 2/1996 Stupar
5,588,532 A 12/1996 Pharo
5,681,574 A * 10/1997 Haber et al. ..... 424/402
D386,074 S 11/1997 Pharo
5,711,691 A 1/1998 Damask et al.
5,775,491 A 7/1998 Taniyama
5,792,213 A 8/1998 Bowen
5,814,159 A 9/1998 Paley et al.
5,865,309 A 2/1999 Futagawa et al.
5,870,884 A 2/1999 Pike
5,881,869 A * 3/1999 Hudson ..... 206/219
5,910,138 A 6/1999 Sperko et al.
5,928,213 A 7/1999 Barney et al.
5,944,709 A 8/1999 Barney et al.
5,967,308 A 10/1999 Bowen
6,001,187 A 12/1999 Paley et al.
6,007,264 A 12/1999 Koptis
6,036,004 A 3/2000 Bowen
6,068,820 A 5/2000 De Guzman
6,165,161 A 12/2000 York et al.
6,198,106 B1 3/2001 Barney et al.
6,203,535 B1 3/2001 Barney et al.
6,468,377 B1 10/2002 Sperko et al.
6,491,159 B2 12/2002 Shibata
6,547,468 B2 4/2003 Gruenbacher et al.
6,726,364 B2 4/2004 Perell
6,845,883 B2 * 1/2005 Pieri ..... 222/94
6,846,305 B2 1/2005 Smith et al.
6,935,492 B1 8/2005 Loeb
6,968,952 B2 11/2005 Crevier et al.
6,996,951 B2 2/2006 Smith et al.
7,051,879 B2 5/2006 Ramet
7,055,683 B2 6/2006 Bourque et al.
7,175,614 B2 2/2007 Gollier et al.
7,306,095 B1 12/2007 Bourque et al.
2002/0150658 A1 10/2002 Morrissette et al.
2002/0170832 A1 11/2002 Klair
2003/0019781 A1 1/2003 Kocher
2004/0057638 A1 3/2004 Perell et al.
2004/0226848 A1 11/2004 Dunn-Rankin
2006/0023976 A1 2/2006 Alvater et al.
2006/0126970 A1 6/2006 Perell

FOREIGN PATENT DOCUMENTS

EP 00306207 A1 3/1989
EP 00317130 A1 5/1989
FR 2 345363 A1 10/1977
GB 2253605 A 9/1992
JP 04215927 A 8/1992
JP 11029176 A1 2/1999
JP 2000255598 A 9/2000
WO WO 96/23700 A1 8/1996
WO WO 02/083504 A1 10/2002
WO WO 2004/100856 A2 11/2004
WO WO 2005/022323 A 3/2005
WO WO 2005/077811 A1 8/2005

* cited by examiner

DISPERSING BUBBLE WITH COMPRESSIBLE TRANSPORT FLUID AND METHOD

This application claims the benefit of U.S. provisional application Ser. No. 60/816,045, filed Jun. 26, 2006.

TECHNICAL FIELD

This invention relates to dispersing a product, and more particularly to transporting the product toward a zone of concern using a compressible transport fluid.

BACKGROUND

U.S. Pat. No. 6,726,364 issued on Apr. 27, 2004 to the present inventor shows a breaching bubble with opposed peel flaps along the beaching edge, which are peeled back by the user to open a chamber and present a product. However, the product was neither dispersed nor transported by a compressible transport fluid.

SUMMARY

It is therefore an object of this invention to provide a bubble device for dispersing a product from a dispersing bubble into a zone of concern by transporting the product in the flow of a compressible transport fluid. The transport fluid is inside the dispersing bubble along with the product. The force of compression separates opposed webs forming the dispersing bubble, causing an edge breach in the bubble. The compressed transport fluid and product escape through the edge breach in a release of compressed transport fluid.

It is another object of this invention to provide such a bubble device in which the energy for compressing the transport fluid and dispersing the product is supplied by the user. When dispersion is desired, the user directs the bubble device toward the zone of concern and squeezes the bubble.

It is a further object of this invention to provide such a bubble device is which the product is dispersed without physical contact between the bubble device and the zone of concern. The product is propelled out of the dispersing bubble and toward the zone of concern in a vapor-like state by the compressive energy within the bubble.

It is a further object of this invention to provide such a bubble device having opposed peel tabs by which the user can open the dispersing bubble for access to the product.

It is a further object of this invention to provide such a bubble device in which product residue remaining within the bubble after dispersion is applied to the zone of concern by physical contact between the opposed webs and the zone. The opposed webs may be completely separated, providing two applicator pads, each carrying some product residue.

It is a further object of this invention to provide such a bubble device which is conveniently discarded after dispersion. The opposed webs form a wrap pocket adjacent to the dispersing bubble which may receive the depleted breached bubble.

It is a further object of this invention to provide such a bubble device with a plurality of dispersion bubbles with a selection of products for use in sequence.

It is a further object of this invention to provide such a bubble device which disperses an additional portion of vaporized product. The additional portion vaporizes as the transport fluid warms due to compression, and condenses as the transport fluid cools due to expansion outside the dispersing bubble.

Briefly, these and other objects of the present invention are accomplished by providing a bubble device for permitting a user to directionally disperse a product under compressive pressure toward a zone of concern. Opposed webs of enclosure material are pressed together to form a sealed perimeter around a central enclosure. The perimeter has a breaching seal for product dispersion and a non-breaching seal along the remainder of the perimeter. The central enclosure forms a dispersing bubble enclosed between the opposed webs within the perimeter. A product and a compressible product transport fluid are contained within the dispersing bubble. The transport fluid is compressed under the external pressure, causing the opposed webs to separate along the breaching seal inside the dispersing bubble. The web separation forces an edge breach in the breaching seal from inside to outside. The compressed transport fluid rapidly escapes as a released blast through the edge breach and expands out of the dispersing bubble. The escaping expanding transport fluid transports at least a portion of the product out of the bubble for dispersion toward the zone of concern.

BRIEF DESCRIPTION OF THE DRAWINGS

Further objects and advantages of the present dispersing bubble and the operation of transport fluid will become apparent from the following detailed description and drawings (not drawn to scale) and flow chart in which.

Figure 1A:
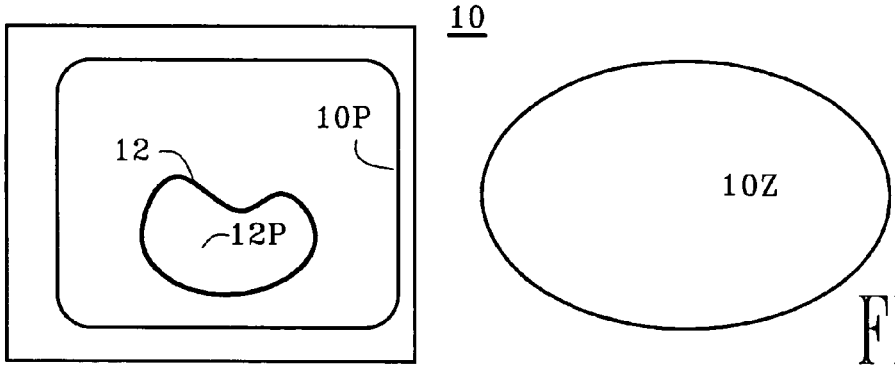
FIG. 1A is a plan view of bubble device 10 showing dispersing bubble 12 and product 12P within sealed perimeter 10P for dispersion into zone of concern 10Z.

The first digit of each reference numeral in the above figures indicates the figure in which an element or feature is most prominently shown. The second digit indicates related elements or features, and a final letter (when used) indicates a sub-portion of an element or feature.

REFERENCE NUMERALS IN DRAWINGS

The table below lists the reference numerals employed in the figures, and identifies the element designated by each numeral.

10 Bubble Device 10
10B Breaching Seal 10B
10C Cover Web 10C
10N Non-breaching Seal 10N
10P Sealed Perimeter 10P
10S Support Web 10S
10Z Zone of Concern 10Z
12 Dispersing Bubble 12
12B Product Surface Boundary 12B
12C Peel Tab 12C
12E Edge Breach 12E
12F Compressible Transport Fluid 12F
12P Product 12P
12R Product Residue 12R
12S Peel Tab 12S
22 Plurality of Bubble Devices 22
24A Array 24A
24L Perforated Lines 24L
30B Breaching Seal 30B
30I Selected Product 30I
30II Selected Product 30II
30III Selected Product 30III
30IV Selected Product 30IV
30V Selected Product 30V
32 Plurality of Bubble Devices 32
34S Strip 34S
42 Dispersing Bubble 42
44A Axis 44A
44D Dispenser 44D
44R Roll 44R
50 Bubble Device 50
50C Convex Cover Web 50C
50S Convex Support Web 50S
52C Convex Bubble 52C
52S Convex Bubble 52S
66 Bubble Device 60
60S Support Web 60S
62 Dispersion Bubble 62
66W Wrap Member 66W
66P Discard Pocket 66P
70 Bubble Device 70
70B Breaching Seal 70B
70N Non-breaching Seal 70N
72 Dispersion Bubble 72
72P Product 72P
76S Product Swab 76S General Embodiment—(FIG. 1 ABCDE)

Figure 1B:
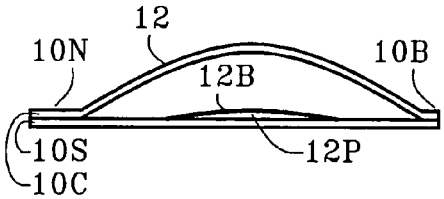
FIG. 1B is a sectional view of the bubble device and dispersing bubble of FIG. 1A showing opposed webs 10S and 10C with breaching seal 10B and non-breaching seal 10N.

Bubble device 10 permits a user to directionally disperse a product under compressive pressure toward zone of concern 10Z. Opposed webs 10S and 10C of enclosure material are pressed together to form sealed perimeter 10P around a central enclosure. The central enclosure forms dispersing bubble 12 enclosed between the opposed webs within the perimeter. The opposed webs may have multiple layers to provide properties such as waterproofing, UV protection, increased bulk, and strength. The opposed webs may be any suitable enclosing material such as plastic, paper fabric, cellophane, or biodegradable matter. Thin mylar plastic forms a flexible film with hermetic properties, and may be employed as a bubble material. The perimeter has a breaching seal 10B for product dispersion and a non-breaching seal 10N along the remaining perimeter. The breaching seal of the bubble device may be a frangible web union and the non-breaching seal may be a destructive web union. The frangible breaching seal may be formed at a lower web-to-web pressure and at a lower temperature for a shorter time than the destructive non-breaching seal. The frangible seal breaches at a lower pressure and requires less compressive energy. The breaching seal may be narrower than the non-breaching seal (as shown in FIGS. 1A and 1B). The narrow breaching seal requires less bubble enlargement to force an edge breach.

Product 10P for dispersion and compressible product transport fluid 12F are contained within the dispersing bubble. The transport fluid may be any compressible medium such as a chemically pure gas or nitrogen gas or other inert gas (or combination of gases) or ambient air or other suitable fluid. The transport fluid is compressed under external pressure applied by the user, for causing the opposed webs to separate and the bubble to enlarge along the breaching seal. The user provides the external pressure manually by pressing on the dispersing bubble between the user's thumb and forefinger. In other embodiments, mechanical devices may be employed to create the compression. As the transport fluid is compressed, energy of compression builds and is stored within the dispersing bubble. The compression causes the bubble to bulge toward the frangible breaching seal (see FIG. 1C). The web separation occurs inside the dispersing bubble, forcing an edge breach 12E in the breaching seal from the inside to the outside. The compressed transport fluid rapidly escapes as a released blast through the edge breach, and expands as it passes out of the dispersing bubble. The stored energy of compression within the bubble is released as kinetic energy of the escaping transport fluid.

The escaping expanding transport fluid transports at least a portion of the product out of the bubble for dispersion toward zone of concern 10Z adjacent to the dispersing bubble. The zone may be an area of skin enhanced by a perfume product or being treated by a beneficial substance such as an ointment or medication. The zone may be a medical machine or a portion of a working surface or a surgical instrument, being sterilized by an antiseptic vapor without contact.

The bubble device has opposed peel tabs 12S and 12C formed by the enclosure material of the opposed webs proximate the edge breach as the bubble breaches. The tabs may be peeled apart by the user to further separate the opposed webs and gain access to product residue remaining in the bubble after the escape of the fluid. The opposed webs 10S and 10C may be completely separated forming application pads (see FIG. 1E) for applying any product residue 12R remaining on the webs after the dispersion.

Product 12P—(FIG. 1ABCDE)

The product contained within the dispersing bubble may be a liquid or a gas or a powder, or a combination thereof. A portion of the product becomes mingled with the transport fluid and is transported through the edge breach with the rapidly escaping transport fluid. The mingled product is carried by the transport fluid in solution, as a mixture, or as a suspension of minute airborne particles. The product may be a finely divided powder such as graphite lubricant or confectioner's sugar or fingerprint toning powder, which is temporarily airborne just after the dispersion. The dust-like powder quickly settles onto the zone of concern. The graphite powder settles as film of lubricant, and the confectioner's sugar settles as a decorative sweet frosting, and the fingerprint powder tones the oil patterns. The presence of the mingled product may be enhanced by shaking the device just prior to dispersion.

The product contained within the dispersing bubble has surface boundary 12B exposed to the transport fluid. A portion of the liquid product maybe atomized into the transport fluid during the dispersion by the rapid flow of the of the transport fluid across the surface. The velocity of the transport fluid creates a low pressure above the liquid product which pulls the product atoms and/or molecules across the surface boundary into the flow. This atomized product is transported through the edge breach with the escaping transport fluid.

A portion of the liquid product is vaporized into the transport fluid reaching a vapor pressure equilibrium. A slight additional portion vaporizes across the surface boundary as the transport fluid warms due to compression within the dispersing bubble. A corresponding slight portion of vapor condenses out of the transport fluid as the transport fluid cools due to expansion outside the dispersing bubble. A mist of condensation settles onto the zone of concern and gives the user feedback as to the direction of the dispersion. A portion of the liquid product contained within the dispersing bubble may be transported through the edge breach as small blast droplets of product by the rapidly escaping transport fluid. These droplets soon fall out of the escaping flow onto the zone.

A portion of the liquid product contained within the dispersing bubble may remain as surface residue 12R on the enclosure material of the breached dispersing bubble after the product dispersion. Alternatively, the liquid product may be completely mingled into the transport fluid leaving no residue on the opposed webs after dispersion.

In a fluid embodiment, the product may be a gas which is completely mixed with the transport fluid. The gas product may function as its own compressible transport fluid, in which case the entire content of the dispersing bubble is the gas product. In this fluid embodiment, there is no liquid or powder or residue remaining on the web material.

Portable Embodiments

Liquid products such as perfumes, sun-screen lotion, deodorants, insect repellant etc., may be packaged in a bubble pack carried in a handbag for immediate use. The bubble may be a light, compact unit suitable containing a single application of the product weighing a fraction of a gram. A single ounce of upscale perfume may be costly, and typically comes in a thick, heavy glass vial, difficult to transport in a handbag. The small bubble pack may be employed for samples distributed from retail counters, and for small amounts of products typically found in hotel bathrooms. A smaller household version may be available to consumers at the super-market or in drugstores.

Pandemic Embodiment

The liquid product within the bubble may be a disinfectant for viral, bacterial, and other airborne or contact pathogens in pandemic situations. First response personnel may carry a supply of disinfectant bubbles along with protective latex gloves. A large carton containing thousands of light, cheap disinfectant bubbles, weighing only a few pounds, could easily be distributed to the public from emergency stations.

Figure 7A:
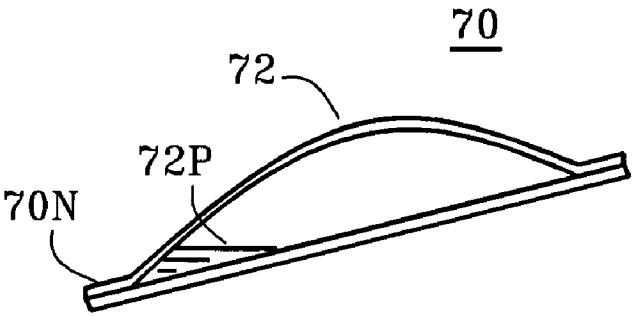
FIG. 7A is a side view of bubble device 70 with dispersion bubble 72 tilted upward showing product 72P in the lower rear region of the bubble next to non-breaching seal 70N.
Figure 7B:
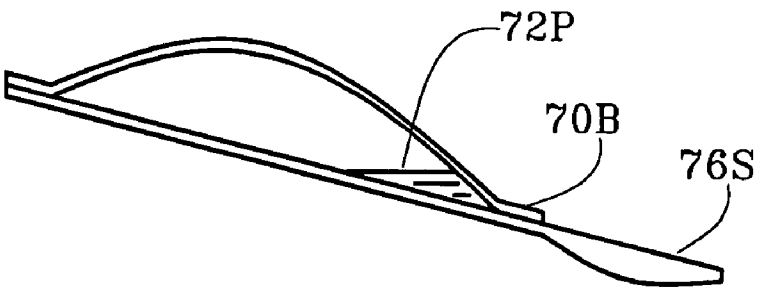
FIG. 7B is a side view of the bubble device of FIG. 7A showing dispersion bubble 72 tilted downward with product 72P in the lower forward region of the bubble next to breaching seal 70B.

Product Swab 76S—(FIG. 7B)

Product swab 76S of enclosure material may be provided proximate the edge breach for transferring product to zone of concern by physical contact. The product swab may be an extension of the lower web for catching the blast droplets and condensate after they have been transported through the edge breach and fallen-out of the escaping flow. The extended lower lip may be concave in shape for retaining the fallen-out product.

Figure 3:
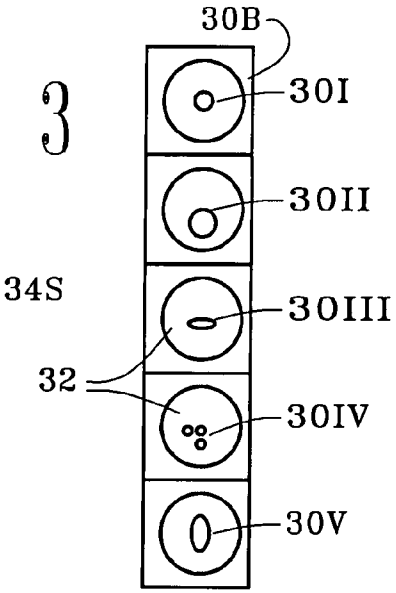
FIG. 3 is a plan view of a strip 34S with a plurality of bubble devices 32 showing selected products 30I to 30V.
Figure 2:
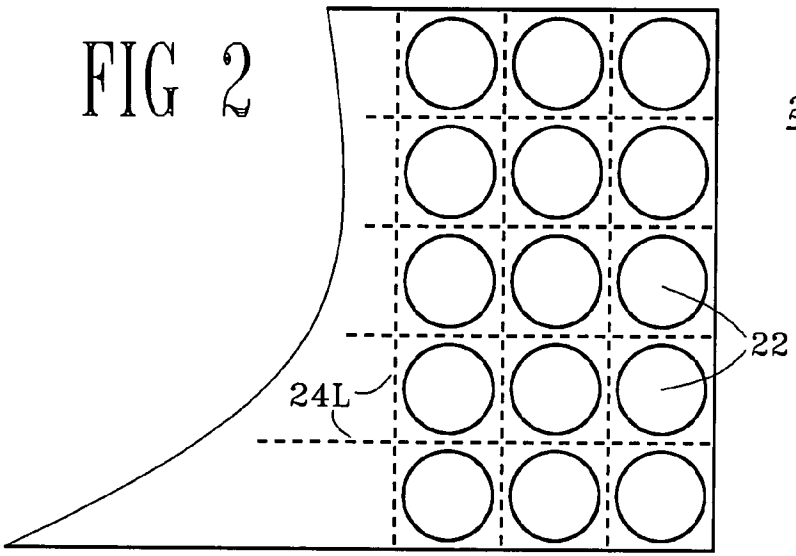
FIG. 2 is a plan view of an array 24A with a plurality of bubble devices 22 showing perforated lines 24L for separation.
Figure 4:
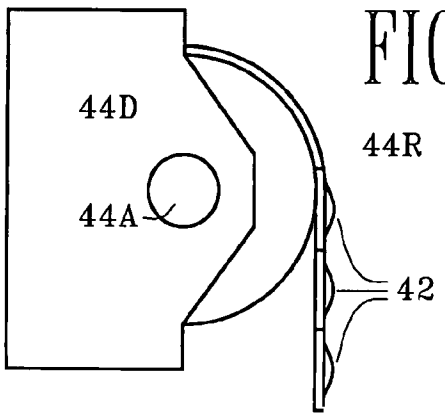
FIG. 4 is a side view of a roll 44R of bubble devices 42 mounted on dispenser 44D.

Presentation—(FIGS. 2, 3, and 4)

Bubble devices each with a dispersing bubble, may be presented in array 24A formed by opposed web sheets to provide a plurality of dispersing bubble 22 on single support. Lines of perforations 24L define a four-sided separation grid between the bubble devices, permitting the devices to be individually removed from the array. The user may tear off one or more devices, or remove an entire strip (see FIG. 3), along the perforations.

Dispersing bubbles 32 in linear strip 34S may contain a selection of products 30I, 30II, 30III, 30IV and 30V for dispersion. The selection of products may be dispersed into the zone of concern in a specified protocol or time sequence. For example, medical procedures may involve several antiseptic and preparatory actions executed in a prescribed order. A strip may be provided with multiple dispersing bubbles, each holding whatever substance is required for each action. A blood donor typically gets a liberal alcohol wash around the IV insertion area, and then a local iodine rub. Alcohol and iodine may be provided at the donor station in a convenient disposable two bubble strip. A supply of strips for similar consumer protocols may be carried in the consumers purse or pack. Breaching seal 30B on each dispersing bubble may be along the same edge of the strip defining a common dispersion direction for all of the bubbles in the strip.

Alternatively, a bubble device may present dispersing bubbles 42 from a suitable dispensing structure 44D employing a roll 44R. The roll unwinds around axis 44A as the user tears off each individual dispersing bubble.

Figure 5:
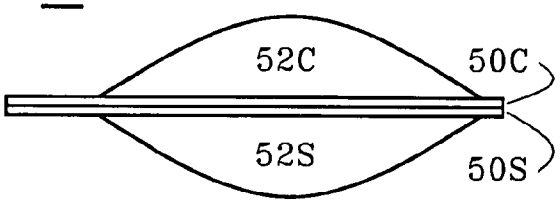
FIG. 5 is a side view of bubble device 50 showing convex support web 50S and convex cover web 50C.

Support/Cover Webs—(FIG. 5)

One of the opposed webs forming the dispersing bubbles may be support web 50S and the other opposed web may be cover web 50C. Both the support web and the cover web may be convex forming support convex portion 52S of the bubble and cover convex portion 52C, defining a double convex dispersing bubble as shown in FIG. 5. Alternatively, the support web may be flat and the cover web may be convex defining a stable dispersing bubble (see FIG. 7AB). During manufacturing, the web material may be pulled into the convex shape by a vacuum. The convex shape retains the product in position until the opposed web is pressed into place.

Figure 6:
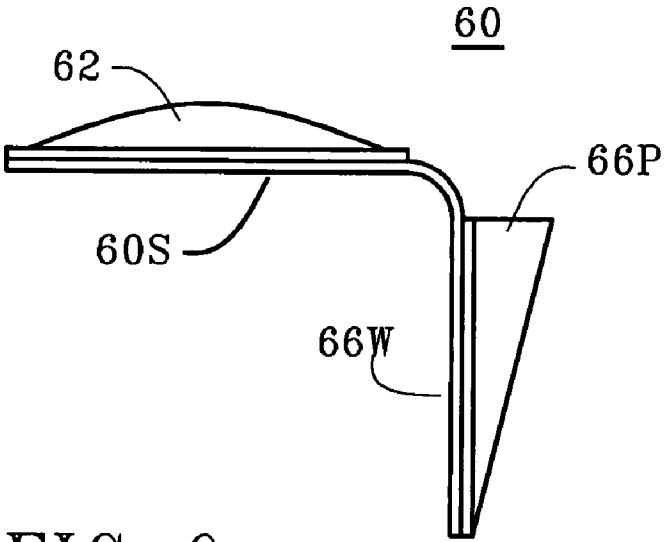
FIG. 6 is a side view of bubble device 60 with dispersion bubble 62 showing wrap member 66W with discard pocket 66P for disposing the breached bubble after dispersion.

Wrap Pocket—(FIG. 6)

The remnants of the breached bubble coated with the residue of the product, may be folded up and discarded directly. Alternatively, the bubble may have an attached cloak or shroud, which may be used to wrap the breached bubble. A wrap member extending from at least one of the opposed webs may be employed for wrapping the breached dispersing bubble after dispersion of the product. In the embodiment of FIG. 6, wrap member 66W is formed on support web 60B of bubble device 60, and provides discard pocket 66P for receiving the breached dispersing bubble. The used bubble device may be rolled and tucked into the pocket for disposal. The encased bubble remnant may be temporarily stored in a handbag for disposal later. The wrapped storage permits a second and possible third application of the product.

Figure 8:
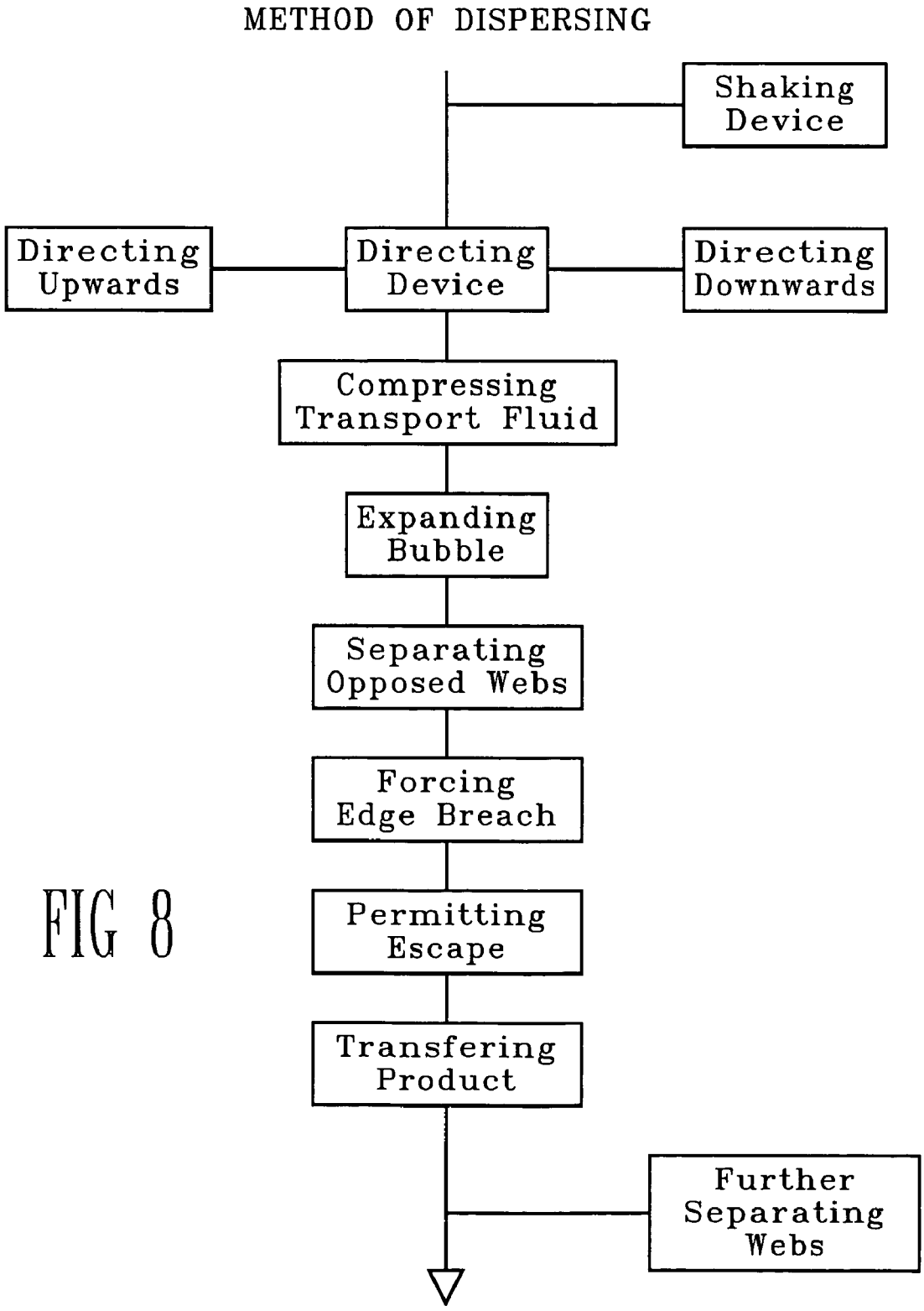
FIG. 8 is a flow chart showing the basic steps and sub-steps in the method of dispersion.

Method of Dispersing (FIG. 8)

The basic steps of the general method for directionally dispersing a product toward a zone of concern under compressive pressure by a user are shown in the flow chart of FIG. 8, and described below, and in FIG. 1ABCDE above.

Directing a bubble device toward the zone of concern. The bubble device is formed by opposed webs of enclosure material pressed together to form a sealed perimeter around a central enclosure. The perimeter has a breaching seal for product dispersion, and a non-breaching seal along the remaining perimeter. The central enclosure forms a dispersing bubble enclosed between the opposed webs within the perimeter. The dispersing bubble contains a product for dispersion and a compressible product transport fluid.

Figure 1C:
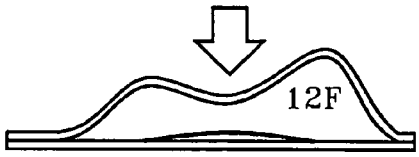
FIG. 1C is a sectional view of the bubble device and dispersing bubble of FIG. 1A showing transport fluid 12F within the dispersion bubble in a compressed state under external pressure.

Compressing the transport fluid within the dispersing bubble by external pressure form the user (see FIG. 1C).

Expanding the dispersing bubble along the breaching seal inside the dispersing bubble under the external pressure on the transport fluid (see FIG. 1C).

Figure 1D:
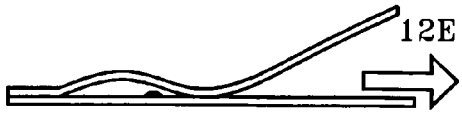
FIG. 1D is a sectional view of the bubble device and dispersing bubble of FIG. 1A showing edge breach 12E along the breaching seal and the transport fluid escaping into the zone of concern.

Separating the opposed webs along the breaching seal (see FIG. 1D).

Forcing an edge breach in the breaching seal from inside to outside due to the separation of the opposed webs (see FIG. 1D).

Permitting the compressed transport fluid to rapidly escape as a released blast through the edge breach, and expand out of the bubble (see FIG. 1D).

Transporting at least a portion of the product out of the bubble with the escaping transport fluid for dispersions toward the zone of concern (see FIG. 1D).

The above general method may have the following additional sub-steps.

Shaking the product and the transport fluid within the dispersing bubble before the directing step to enhance the presence of the product mingled in the transport fluid.

Directing the bubble device upwards during the directing step causing the product within the dispersing bubble to shift downwards and backwards away from breaching seal (see FIG. 7A). The absence of liquid product near the breaching seal insures the dispersion into the zone of concern will be mostly vapor, and include less liquid.

Directing the bubble device downwards during the directing step causing the product within the dispersing bubble to shift downwards and forwards closer to the breaching seal (see FIG. 7B). The existence of liquid product near the breaching seal insures the dispersion will include almost all of the liquid product along with the vapor.

Figure 1E:
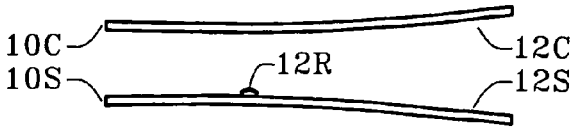
FIG. 1E is a side view of the bubble device and dispersing bubble of FIG. 1A showing the opposed webs 10S and 10C completely separated and residue product 12R exposed.

Further separating the opposed webs after the dispersion step by means of opposed peel tabs formed on the opposed webs proximate the edge breach (see FIG. 1E).

The above method has many variations and applications. For example, in a perfume dispersion scenario, the consumer has four procedure options:

Light Scent

Limited scent may be obtained from the initial cloud of carburetted mist plus the single molecules of perfume dissolved (evaporated) into the transport fluid.

Medium Scent

More scent may be obtained by agitating the bubble lightly through tapping or shaking before breaching, to include liquid product temporarily suspended in the transport fluid due to the agitation.

More Scent

Even more scent may be obtained by tilting the bubble downward to include more liquid product in the transport fluid.

Maximum Scent

The most scent may be obtained by heavy agitation to maximize the amount of suspended liquid. Then using the product remaining as a coating on the inside surface of the bubble.

INDUSTRIAL APPLICABILITY

It will be apparent to those skilled in the art that the objects of this invention have been achieved as described hereinbefore by providing a bubble device for dispersing a product from a dispersing bubble into a zone of concern. The force of compression forces an edge breach in the bubble. The compressed transport fluid and product escape through the edge breach in a release of compressed transport fluid. The energy for compressing the transport fluid the product is supplied by the user. The product is dispersed without physical contact with the zone of concern. The product is propelled out of the dispersing bubble in a vapor state by the compressive energy within the bubble. The bubble device has opposed peel tabs permitting the user to open the dispersing bubble for access to the product. Product residue remaining within the bubble is applied to the zone of concern by contact application. The bubble device may be conveniently discarded after dispersion in a wrap pocket. The bubble device may have a plurality of dispersion bubbles with a selection of products for use in sequence. An additional portion of product vaporizes as the transport fluid warms due to compression, and condenses as the transport fluid cools due to expansion outside the dispersing bubble.

Various changes may be made in the structure and embodiments shown herein without departing from the concept of the invention. Further, features of embodiments shown in various figures may be employed in combination with embodiments shown in other figures.

Therefore, the scope of the invention is to be determined by the terminology of the following claims and the legal equivalents thereof.

I claim as my invention:

1. Bubble device for permitting a user to directionally disperse a product toward a zone of concern, comprising:

opposed webs of enclosure material pressed together to form a sealed perimeter around a central enclosure, the perimeter having a breaching seal for product dispersion and a non-breaching seal along the remaining perimeter, the breaching seal comprising a frangible web union, the breaching seal disposed adjacent an edge of the bubble device and substantially coextensive with the width or diameter of the central enclosure;

the central enclosure forming a dispersing bubble enclosed between the opposed webs within the perimeter;

product contained within the dispersing bubble;

compressible product transport fluid contained within the dispersing bubble;

the transport fluid is compressed under external pressure, causing the opposed webs to separate along the breaching seal inside the dispersing bubble, forcing an edge breach in the breaching seal from inside to outside;

the compressed transport fluid rapidly escapes as a released blast through the edge breach and expands out of the dispersing bubble;

the escaping expanding transport fluid transports at least a portion of the product out of the bubble for directional dispersion toward the zone of concern; and opposed peel tabs formed by the enclosure material of the opposed webs proximate the edge breach as the bubble breaches, which tabs may be peeled apart by the user to further separate the opposed webs.

2. The bubble device of claim 1, wherein a portion of the product contained within the dispersing bubble is mingled with the transport fluid and is transported through the edge breach with the rapidly escaping transport fluid.

3. The bubble device of claim 2, wherein another portion of the product contained within the dispersing bubble is in liquid form, some of which goes into the transport fluid as the transport fluid warms due to compression within the dispersing bubble, and condenses out of the transport fluid into the zone of concern as the transport fluid cools due to expansion outside the dispersing bubble.

4. The bubble device of claim 1, wherein at least some product contained within the dispersing bubble is in liquid form having a surface exposed to the transport fluid, a portion of which liquid is atomized into the transport fluid by the rapid flow of the of the transport fluid across the surface, and which is transported through the edge breach with the escaping transport fluid.

5. The bubble device of claim 1, wherein at least some product contained within the dispersing bubble is in liquid form, a portion of which remains as surface residue on the enclosure material of the breached dispersing bubble after the product dispersion.

6. The bubble device of claim 1, wherein at least some product contained within the dispersing bubble is in liquid form, a portion of which is transported through the edge breach as blast droplets of product by the rapidly escaping transport fluid.

7. The bubble device of claim 1, wherein the dispersing bubble is an array of dispersing bubbles enclosed between sheets of opposed webs.

8. The bubble device of claim 1, wherein the dispersing bubble is a roll of dispersing bubbles.

9. The bubble device of claim 1, wherein the dispersing bubble is a strip of dispersing bubbles.

10. The bubble device of claim 9, wherein the dispersing bubbles in the strip contain a selection of products for dispersion.

11. The bubble device of claim 10, wherein the selection of products in the strip of dispersing bubbles are applied in a protocol sequence.

12. The bubble device of claim 10, wherein the breaching seals on each of the dispersing bubbles are along the same edge of the strip.

13. The bubble device of claim 1, wherein one of the opposed webs is a support web and the other opposed web is a cover web.

14. The bubble device of claim 13, wherein the support web is flat and the cover web is convex defining the dispersing bubble.

15. The bubble device of claim 13, wherein both the support web and the cover web are convex defining the dispersing bubble.

16. A method for directionally dispersing a product toward a zone of concern under compressive pressure by a user, comprising the steps of:

directing a bubble device toward the zone of concern, the bubble device is formed by opposed webs of enclosure material pressed together to form a sealed perimeter having around a central enclosure, the perimeter having a breaching seal for product dispersion that comprises a frangible web union, the breaching seal disposed adjacent an edge of the bubble device, and a non-breaching seal along the remaining perimeter, the central enclosure forming a dispersing bubble enclosed between the opposed webs within the perimeter, the dispersing bubble contains a product for dispersion and a compressible product transport fluid, and wherein the zone of concern is separate from the bubble device and external to the opposed webs of enclosure material;

compressing the transport fluid within the dispersing bubble by external pressure;

expanding the dispersing bubble along the breaching seal inside the dispersing bubble under the external pressure on the transport fluid;

separating the opposed webs along the breaching seal;

forcing an edge breach in the breaching seal from inside to outside due to the separation of the opposed webs;

permitting the compressed transport fluid to rapidly escape as a released blast through the edge breach, and expand out of the bubble and away from the bubble device;

transporting at least a portion of the product out of the bubble and away from the bubble device with the escaping transport fluid for dispersions toward the zone of concern; and wherein after the dispersion step further comprising the additional step of further separating the opposed webs by means of opposed peel tabs formed on the opposed webs proximate the edge breach as the dispersing bubble breaches.

17. The method of claim 16, further comprising before the directing step, the step of shaking the product and the transport fluid within the dispersing bubble.

18. The method of claim 16, wherein during the directing step the bubble device is directed upwards causing the product within the dispersing bubble to shift downwards away from breaching seal.

19. The method of claim 16, wherein during the directing step the bubble device is directed downwards causing the product within the dispersing bubble to shift downwards closer to the breaching seal.

* * * * *